US012478191B2

(12) United States Patent
Rubin

(10) Patent No.: US 12,478,191 B2
(45) Date of Patent: Nov. 25, 2025

(54) SYSTEMS AND METHODS FOR BEDDING SECUREMENT

(71) Applicant: William Rubin, La Mesa, CA (US)

(72) Inventor: William Rubin, La Mesa, CA (US)

( * ) Notice: Subject to any disclaimer, the term of this patent is extended or adjusted under 35 U.S.C. 154(b) by 351 days.

(21) Appl. No.: 18/069,793

(22) Filed: Dec. 21, 2022

(65) Prior Publication Data

US 2024/0206635 A1 Jun. 27, 2024

(51) Int. Cl.
*A47C 21/02* (2006.01)
*A47G 9/02* (2006.01)

(52) U.S. Cl.
CPC ..... *A47C 21/022* (2013.01); *A47C 21/026* (2013.01); *A47G 9/02* (2013.01)

(58) Field of Classification Search
CPC ..... A47C 21/022; A47C 21/026
USPC ..... 5/498
See application file for complete search history.

(56) References Cited

U.S. PATENT DOCUMENTS 918,775 A * 4/1909 Schloss ..... A44B 1/24 24/114.12
2,314,482 A * 3/1943 Walter ..... A47C 27/05 5/721
2,799,870 A * 7/1957 Sullivan ..... A47G 9/0238 5/495
2,810,921 A * 10/1957 Seidenberg ..... A47G 9/0261 5/501
2,836,869 A * 6/1958 Adinolfi ..... A44B 1/12 24/113 R
4,167,053 A * 9/1979 Ptasinski ..... A44B 1/12 79/1
2018/0146805 A1 5/2018 Stinchcomb
2021/0386222 A1* 12/2021 O'Veal ..... A47G 9/0253

* cited by examiner

*Primary Examiner* — David R Hare
*Assistant Examiner* — Joseane E. Tejada
(74) *Attorney, Agent, or Firm* — Sheppard Mullin Richter & Hampton LLP

(57) ABSTRACT

The present disclosure provides one or more embodiments involving a novel bedding system that, for example, promotes control of a blanket, a sheet, and/or a pillowcase. The present disclosure improves and maintains bedding placement when one is in a bed, such that a blanket does not become congested or misaligned in relation to a top sheet or in relation to the bed itself. One or more embodiments of the bedding system include buttons located on the sheet and/or pillowcase that feed through holes on the blanket and the opposite side of the pillowcase, thereby securing the sheet to the blanket and allowing the pillowcase to reliably encapsulate a pillow contained within.

18 Claims, 4 Drawing Sheets

SYSTEMS AND METHODS FOR BEDDING SECUREMENT

TECHNICAL FIELD

The present disclosure relates generally to systems and methods for bedding securement. In particular, some implementations relate to a bedding system that secures a top sheet to a blanket with one or more buttons and a pillowcase that secures a pillow insert with one or more buttons.

BACKGROUND

Restless sleep can be a result of many different factors, including temperature irregularities, discomfort, and other physiological conditions. These issues are exacerbated by having a bedding system that does not maintain a uniform distribution or orientation throughout the period during which the user is in bed. Further, general movement in a bed can reduce levels of comfort when in the bed, for example, if the bedding itself has become congested or misaligned from said movement. For example, a typical bedding system may include a mattress with a fitted sheet stretched over and secured to a portion of the mattress that is slept or rested on by an individual, a top sheet that is draped over the individual and the fitted sheet, and a blanket that is placed on top of the top sheet. In some cases, a person may toss and turn in their sleep or otherwise move around in bed, for example while watching television or reading, resulting in a mispositioning of the bedding. In particular, the blanket may become separated in relation to the top sheet. In particularly egregious cases, the restlessness may become significant enough that bedding, such as the blanket, may fall off the bed onto the floor, further worsening the potential temperature irregularities and/or discomfort that contribute to the restlessness altogether.

This problem may be compounded for those with limited mobility or members of our senior citizen community, as their limited mobility may make retrieving a fallen blanket or reorienting a blanket in relation to a top sheet more difficult or even impossible. This can further be worsened for those recovering from surgery or in the hospital setting, where pulling on a sheet or blanket may exceed the weight a post-operative patient can exert, or may require movements that are beyond the recommended range for patient recovery. As such, it remains difficult to locate, retrieve, and reorient bedding, impacting a person's restful sleep or comfort level when in bed.

Similar problems may arise with pillows in relation to pillowcases, where nighttime or other movement or restlessness may retract the pillowcase from the pillow insert, exposing a portion of the pillow insert. This may lead to faster degradation of pillow inserts as it exposes the unwashable pillow insert to harmful oils, hair products, and other contaminants present on a person's head. Additionally, having a pillow insert become separated from its pillowcase may be difficult to remedy for those with limited mobility, for example, post-operative surgery patients who may not be able to sit up on their own to re-enclose the pillow. As such, for some it remains difficult to locate, retrieve, and reassemble pillows, further impacting restful sleep or other time in bed.

SUMMARY

The present disclosure overcomes the drawbacks of conventional bedding systems by providing buttons on a top sheet and button holes on a blanket to secure the blanket to the top sheet.

In one or more embodiments a bedding system may include a top sheet with at least one button and a blanket with at least one button hole that is configured to receive the at least one button of the top sheet. The at least one button of the top sheet may be fed through the at least one button hole of the blanket, fixing the blanket to the top sheet and thereby reducing the likelihood of the blanket separating from the top sheet. In one or more embodiments, the bedding system may also include a pillowcase with at least one button hole and a lip with at least one button. The button hole(s) may be configured to receive the button(s), such that when the at least one button is fed through the corresponding button hole(s), the pillowcase may be secured in a closed position around the pillow.

In one or more embodiments, the button may be a substantially spherical shape or other shape that facilitates securing the button in its position in the corresponding button hole. The button may in some cases be attached to the top sheet using a plurality of stitches to reduce the likelihood of the button being torn off of the top sheet. Similarly, the at least one button hole on the blanket, may be reinforced to reduce the likelihood of the button damaging the blanket or otherwise damaging the button hole.

In one or more embodiments, attaching the blanket to the top sheet substantially fixes the blanket and top sheet and prevents them from becoming congested or misoriented in relation to the blanket.

Other features and aspects of the disclosure will become apparent from the following detailed description, taken in conjunction with the accompanying drawings, which illustrate, by way of example, features of the disclosure in accordance with various embodiments. This Summary is not intended to limit the scope of the any of the claims.

BRIEF DESCRIPTION OF THE DRAWINGS

The present disclosure, in accordance with one or more embodiments, is described in detail with reference to the following figures. The drawings are provided for purposes of illustration only and merely depict typical or example embodiments of the disclosure. These drawings are provided to facilitate the reader's understanding of the disclosure and should not necessarily be considered limiting of the breadth, scope, or applicability thereof. It should be noted that for clarity and ease of illustration these drawings are not necessarily made to scale.

Figure 1:
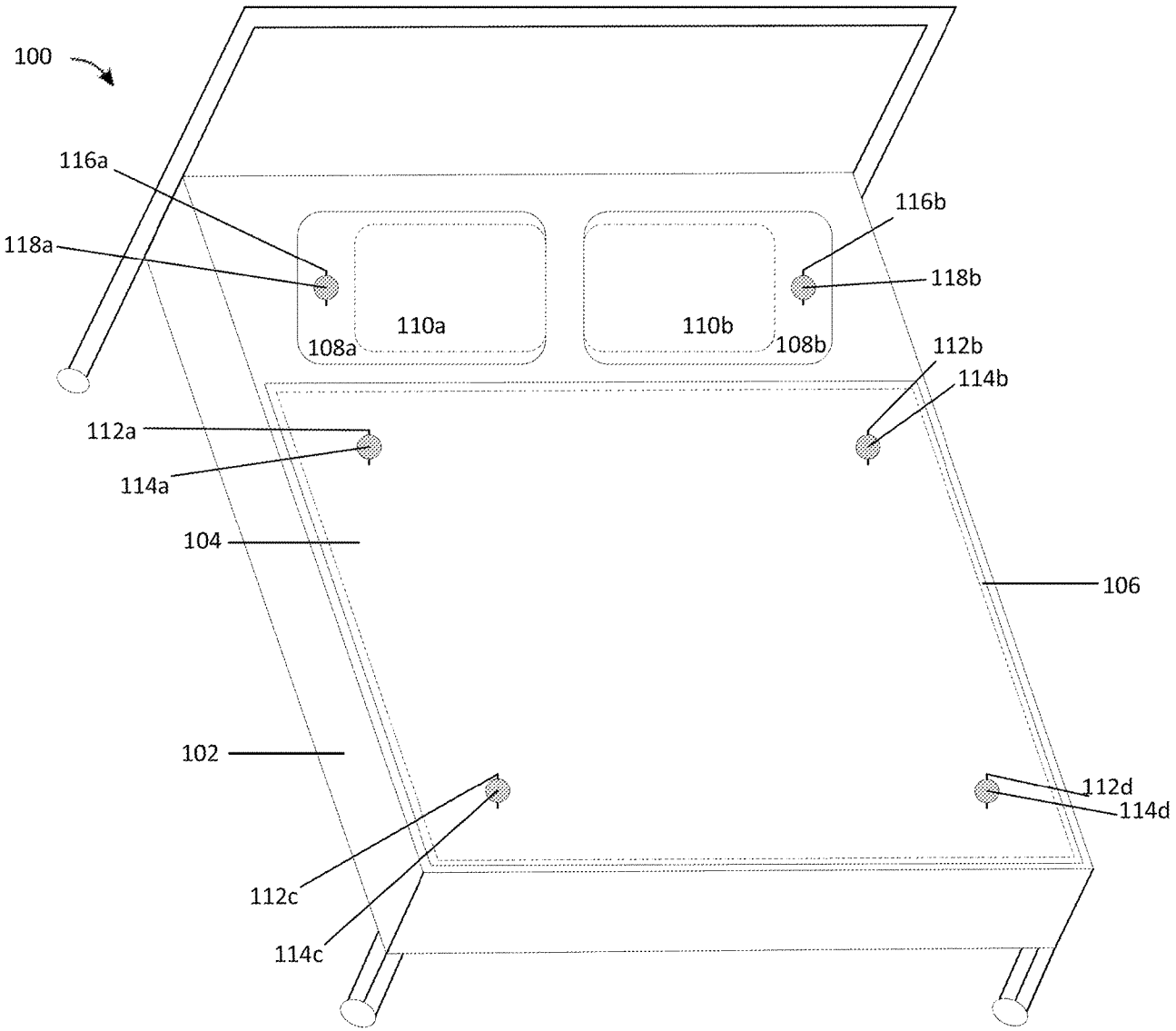
FIG. 1 depicts a perspective view of an example bedding securing system on an example bed, according to one or more embodiments of the present disclosure.

The figures are not intended to be exhaustive or to limit the disclosure to the precise form disclosed. It should be understood that the disclosure can be practiced with modification and alteration.

DETAILED DESCRIPTION

Systems described herein may be used to attach a top sheet to a blanket, which may prevent the blanket from becoming misaligned or separated from the top sheet. Further systems may include a pillowcase that may be secured using a button paired with a button hole to encapsulate a pillow, preventing the pillow from becoming separated from the pillowcase. The blanket and the top sheet may attach to each other using buttons and button holes. The buttons on the top sheet may be configured to pass through button holes in the blanket. Before a user lays in a bed, the user may secure the buttons of the top sheet through the button holes of the blanket. In one or more embodiments, the buttons may be located at or substantially near the four corners of a rectangular or other shaped sheet, and the button holes may be located at the corresponding corners of the blanket. As such, the buttons may not be easily reachable while in a lying position. By attaching the buttons, the blanket may be secured to the top sheet, reducing the likelihood of the blanket sliding off of the top sheet, or otherwise becoming misaligned.

A similar solution may be used for pillows to prevent the separation of a pillow insert from a pillowcases. Here, a button may be used to prevent a pillow insert from leaving or escaping a corresponding pillowcase during handling of the pillow insert/pillowcase combination, when tossing and turning during restless sleep, and/or when otherwise moving while in bed. By way of example, the button may be located on a lip section of the pillowcase. The user may secure the button into the button hole before placing the pillow insert/pillowcase combination onto the bed. Securing the button on the pillowcase through the button hole may encapsulate the pillow within the pillowcase securely and may reduce the likelihood or ability for the pillow to escape the pillowcase.

The bedding system described herein may be the combination of the top sheet and the blanket and the pillow insert and the pillowcase, or may include only the combination of the top sheet and blanket or the combination of the pillow insert and pillowcase. The bedding system may be configured to contain the pillow insert within the pillowcase and also allow the user to have better control over the blanket in relation to the top sheet.

The existence of certain types of buttons may reduce the comfort level of the bedding (for example, because of the hardness of the buttons, such as buttons made from plastic, metal, or other hard material). To alleviate this problem, the novel bedding system of the present disclosure may use softer buttons such as, but not limited to, those that include fabric or other cloth. Such buttons may be three-formed into shapes suitable for securing to a button hole and may include relatively soft filler material to provide the buttons' shape. For example, the buttons and/or filler material may include cotton, as used for making certain sheets. The soft button may allow user to interact with the button when using the bed comfortably. For example, the user may roll onto the button while in bed and without being disturbed by the button pressing into the user's body, since the button is generally soft and can be made from a similar fabric as the top sheet. In one or more embodiments, the button may resemble a small, soft protrusion (e.g., a substantially spherical, cubic, or other shaped fabric button) such that rolling onto the button will not diminish restful sleep or impact the attachment of the button to the sheet. For example, a hard button or magnet may tear the sheet when a user places the user's weight onto the hard button or magnet.

Reference will now be made in detail to various example implementations, some aspects of which are illustrated in the accompanying drawings. In the following detailed description, numerous details may be set forth in order to provide a thorough understanding of the present disclosure and the implementations described herein. However, example implementations described herein may be practiced without such details. In other instances, some methods, procedures, components, and mechanical apparatuses may not be described in detail, so as not to unnecessarily obscure aspects of the implementations. Nevertheless, a skilled artisan will appreciate undescribed details upon studying the present disclosure.

FIG. 1 depicts a perspective view of an example bedding securing system on an example bed, according to one or more embodiments of the present disclosure. Bedding system 100 may include components such as, but not limited to, blanket 104, top sheet 106, pillowcase(s) 108*a* and/or 108*b*, and pillow inserts 110*a* and/or 110*b*, each of which may be configured for bed 102.

Components of bedding system 100 may be compatible with any type of bed 102. For example, an example implementation of bedding system 100 may be compatible with a spring mattress of any shape, e.g., twin, full, queen, or king bed. Furthermore, an example implementation of bedding system 100 may be compatible with other forms of mattresses, such as foam, hybrid, waterbed, air mattress, mattress pad, latex foam, vegan latex mattress, gel, futon, Tempur, orthopedic, or similar surfaces that are slept or laid on. In one or more embodiments, bedding system 100 may be compatible with hammocks. For example, a draping blanket may be secured to a top sheet a placed over a user sleeping in a hammock. In one or more embodiments, bedding system 100 may be compatible with sleeper sofas, couches, sectionals, bean-bag chairs, and other surfaces one may lay on.

Blanket 104 may have button holes 112*a-d* that may be configured to receive buttons 114*a-d* attached onto a surface of the top sheet 116. As shown in FIG. 1, blanket 104 and top sheet 106 may have four button holes 112*a-d* and four corresponding buttons 114*a-d*, respectively. One or more other embodiments may exist where more or less buttons and corresponding button holes are incorporated into top sheet 106 and blanket 104. For example, a top sheet may have four buttons in approximately each corner of the top sheet and four corresponding button holes in approximately each corner of the blanket. In another example, the top sheet may have two buttons in the two corners nearest to a user's head or feet, and two corresponding button holes in the blanket at the corners nearing the user's head or feet.

Securing buttons 114*a-d* through button holes 112*a-d* may secure or affix blanket 104 to top sheet 106, and may reduce the likelihood of blanket 104 separating from top sheet 106. Securing buttons 114*a-d* through button holes 112*a-d* may also reduce the congestion of top sheet 106 in relation to blanket 104 and better maintain general alignment of the two. For example, without the secured buttons, a portion of top sheet 106 may congest (through pushing or pulling) or otherwise divert to a single quadrant underneath blanket 104 or become misaligned. In other words, top sheet 106 may get crumpled under an otherwise evenly dispersed blanket 104. In the example depicted in FIG. 1, securing buttons 114*a-d* through button holes 112*a-d* on blanket 104 at each corner may maintain distribution of top sheet 106 throughout the perimeter (outer edges) of blanket 104.

Blanket 104 may be a four-edged rectangular or square shape. In one or more embodiments, blanket 104 may be a round or elliptical shape. Other shapes of blanket 104 are encompassed by the present disclosure. Blanket 104 may take numerous different forms and types, include a single comforter, for example, a quilt or other type of blanket, or a combination of a duvet and duvet cover. Blanket 104 may also be or include any variation of comforters, quilts, and/or blankets and may be formed using various materials, including cotton (such as percale, pima, supima, Egyptian, or organic), silk, polyester, cotton-poly blend, bamboo, flannel, any other suitable material, or any combination of the foregoing. Where applicable duvet filling may be made from various filling materials including, feathers, feather and down, wool, synthetic microfiber, synthetic hollowfiber, cotton, silk, linen, or any other suitable material.

Blanket 104 may include a number of button holes 112*a-d*. Referring to FIG. 1, in one or more embodiments, blanket 104 may be divided into four quadrants where each quadrant may have at least one button hole. For example, from the perspective shown in FIG. 1, the top left quadrant may have one button hole 112*a*, the top right quadrant may have a different button hole 112*b*, the bottom left quadrant may have another button hole 112*c*, and the bottom right quadrant of the blanket may have yet another button hole 112*d*. Each button hole 112*a-d* may include a slit formed through a top surface and bottom surface of the blanket. The slit forming button holes 112*a-d* may have a large aspect ratio between a width and a length of the button hole and may be formed using a linear straight incision (e.g., a cut going through the entire depth of the fabric). Button holes 112*a-d* may be formed in other shapes and may have carefully selected aspect ratios, such that a button can be inserted through the button hole and secured by the surrounding edges of the button hole once the button has passed therethrough. In one or more embodiments, button holes 112*a-d* may be formed in a direction parallel to the side of bed 102, such that on a rectangular blanket (one where the edge nearest the user's head and at the user's feet is shorter than the side edges), the button holes are formed with an elongated edge parallel to the side edges of bed 102. In other embodiment(s), button holes 112*a-d* may be formed with an elongated edge perpendicular to the side of bed 102. Other configurations for button holes 112*a-d* are encompassed herein, for example, button holes 112*a-d* may be formed at a diagonal angle in relation to the edges of bed 102. Further, in embodiment(s) where there are more than one button hole, the holes 112*a-d* may be formed in uniform orthogonal directions in relation to each other, or may be formed in non-uniform orthogonal directions in relation to each other. For example, first and second button hole 112*a-b* may be formed parallel to the elongated edge of bed 102, and third and fourth button holes 112*c-d* may be formed perpendicular to the elongated edge of bed 102. Various combinations of button hole directions and orientations will be appreciated upon studying the present disclosure and are encompassed by the same.

In one or more embodiments, button holes 112*a-d* may have reinforcement stitching around the perimeter of the hole. In other embodiment(s), button holes 112*a-d* may be reinforced with additional fabric to ruggedize the area. For example, an additional layer of fabric may be added around the area immediately surrounding button holes 112*a-d* on blanket 104. The added fabric may be of the same material as the blanket. In other embodiment(s), a different material may be used to provide reinforcement. The reinforcements may also be a combination of increased or reinforced stitching around button holes 112*a-d* and additional fabric or materials placed around a the edges of button holes 112*a-d*.

In one or more embodiments, the number of button holes 112 may be greater or less than four. The button holes 112 may be placed at various points approximately around the perimeter of blanket 104 (within around one quarter of the distance from the edge of the blanket to a center of the blanket, away from the edge of blanket 104). In embodiment(s), button holes 112 may be evenly radially spaced, such that button holes 112 are placed symmetrically across the horizontal and/or vertical axis of the blanket 104. In other embodiment(s), button holes 112 may be placed in a biased dispersant (e.g., favoring one side of bed 102 more than the other, for example, three button holes on one side and one button hole on the opposite side).

Top sheet 106 may be a four-sided rectangular or square shaped piece of linen that may be placed on a bed in between a fixed sheet and the blanket. In one or more embodiments, top sheet 106 may be a round or elliptical shape. Other shapes of top sheet 106 are encompassed in the present disclosure. Top sheet 106 may be made from cotton (such as percale, pima, supima, Egyptian, or organic), silk, polyester, cotton-poly blend, bamboo, flannel, and/or other materials. Top sheet 106 may include an upper side and a bottom side and may be divisible into four quadrants. Top sheet 106 may be divisible into more or less than four quadrants. The upper side of top sheet 106 may face the blanket, while the bottom side of the top sheet may face the mattress or fixed sheet. The upper side of top sheet 106 may include at least one button 114 within each quadrant of top sheet 106. Referring to FIG. 1, an embodiment of top sheet 106 may include four buttons 114*a-d*.

In other embodiment(s), the number of buttons 114 may be greater or less than four. In such embodiment(s), buttons 114 may be placed approximately around the perimeter of top sheet 106 (in some cases, near the edge, for example, within one foot from the edge of the sheet). Buttons 114 may be evenly radially spaced. In other embodiment(s), buttons 114 may be placed at in a biased dispersant (e.g., favoring one side more than the other).

Buttons 114*a-d* can include a case material and a filling. Buttons 114*a-d* may be a substantially round, spherical shape. Buttons 114*a-d* may take on other shapes in some cases, so long as buttons 114*a-d* fit through the corresponding button holes 112*a-d* and secure top sheet 106 to blanket 104. The casing of buttons 114 can be made from the same material as top sheet 106, but may in some example implementations be made from various materials including, cotton (such as percale, pima, supima, Egyptian, or organic), silk, polyester, cotton-poly blend, bamboo, flannel, any other suitable material, or any combination of the foregoing. The filling may include various materials including feathers, down alternative, memory foam, latex, gel, kapok, hybrid, wool, microbeads, buckwheat, water, other filings, or any combination of the foregoing. The shape of buttons 114*a-d* may be uniform or non-uniform. For example, using feathers as fillings can distort buttons 114*a-d* to a shape, such that they may appear to be more like a flattened ball than spherical ball. Furthermore, using feathers might result in bunching of the filler, resulting in an asymmetrical shape. Buttons 114*a-d* may be configured to fit through corresponding button holes 112*a-d*, meaning that button 114*a-d* may have a cross sectional area small enough to allow fitment through button holes 112*a-d*, but large enough to limit backing out through the same button holes 112*a-d* once inserted. Thus, the cross sectional width and height dimension (or diameter for round buttons) may be slightly smaller than the length of the hole. Buttons 114*a-d* may be attached to the upper side of top sheet 106 using stitches or other various attachment methods, such as fabric glue or staples or other mechanisms. The stitches may be of any type among a variety of stitching patterns.

In one or more embodiments, buttons (not shown) that are of similar material, shape, and size as buttons 114*a-d* on top sheet 106 are attached onto blanket 104. In these embodiment(s), blanket 104 may have an upper side and a bottom side where the buttons may be attached to the upper side. The buttons may not serve a functional purposes and may be referred to as false buttons. These false buttons may serve a decorative purpose. For example, a bedding system may include four buttons attached to the top sheet and four button holes on the blanket, with an additional four decorative buttons also on the blanket, allowing for a more continuous appearance of buttons around the approximate perimeter of the blanket, e.g., each of the four edges of a rectangular blanket may appear to include two buttons, while in actuality the top sheet is secured to the blanket with four of the eight buttons apparent on the top side of the blanket.

Bedding system 100 may also include pillowcases 108*a* and 108*b* that may be configured to receive pillows 110*a* and 110*b*. Pillows 110*a* and 110*b* and pillowcases 108*a* and 108*b* may be configured to match the size of bed 102. For example, a king size bed may include a comparable set of king size pillows and pillowcases. In one or more embodiments, pillowcases 108*a* and 108*b* and pillows 110*a* and 110*b* may be undersized or oversized as compared to bed 114. Pillowcases 108*a* and 108*b* and pillows 110*a* and 110*b* may be of generally rectangular shape and may be configured to match in size. In one or more embodiments, pillowcases 108*a* and 108*b* and pillowcases 110*a* and 110*b* are not rectangular and take on other shapes, such as an oval or non-uniform shapes, such as neck supporting pillows.

Pillowcases 108*a* and 108*b* may have two layers of fabric that are attached on all sides except one, leaving an opening, an inner side, and an outer side. As noted, pillowcases 108*a* and 108*b* may take on other shapes. In other embodiment(s), pillowcases 108*a* and 108*b* may include multiple openings. Pillowcases 108*a* and 108*b* may be made from any fabric, including cotton (such as percale, pima, supima, Egyptian, or organic), silk, polyester, cotton-poly blend, bamboo, flannel, any other suitable material, or any combination of the foregoing.

Pillows 110*a* and 110*b* may be made from any casing material, such as cotton, viscose or lyocell, polyester or blends. Similarly, pillows 110*a* and 110*b* may be filled using material such as down, feathers, down alternative, memory foam, latex, gel, kapok, hybrid, wool, microbeads, buckwheat, water, or other pillow insert fillings.

Pillowcases 108*a* and 108*b* may have at least one button hole 116*a* and 116*b* and at least one button 118*a* and 118*b*. Button holes 116*a* and 116*b* may be located near the opening of pillowcase 108*a* and 108*b*. Button holes 116*a* and 116*b* may have a slit, meaning the holes are created from a linear straight incision (e.g. a cut going through the entire depth of the fabric). In other embodiment(s), the slit may take on other shapes, for example, a circle. Button holes 116*a* and 116*b* may be created in a direction parallel to the side of bed 102. In other embodiment(s), button holes 116*a* and 116*b* may be perpendicular to the side of bed 102. In embodiment(s), button holes 116*a* and 116*b* may have reinforcement stitching around their perimeters, similar to the reinforcements described above in relation to blanket 104.

Pillowcases 108*a* and 108*b* may have at least one button 118*a* and 118*b*. Buttons 118*a* and 118*b* may be located within the inner side near the opening of pillowcase 108*a* and 108*b*, as shown in FIG. 1. Buttons 118*a* and 118*b* may be located on a side opposite to button holes 116*a* and 116*b*. Buttons 118*a* and 118*b* may include a case material and a filling. The casing may include various materials, including cotton (such as percale, pima, supima, Egyptian, or organic), silk, polyester, cotton-poly blend, bamboo, or flannel. The filling may be made from various materials, including feathers, down alternative, memory foam, latex, gel, kapok, hybrid, wool, microbeads, buckwheat, water, any other suitable material, or any combination of the foregoing. Buttons 118*a* and 118*b* may be configured to fit through button holes 116*a* and 116*b*, meaning that the button may have a cross sectional area small enough to allow fitment through button holes 116*a*, 116*b*, but large enough to limit backing out through the same button hole. This may involve a cross sectional width and height dimension (or diameter for round buttons) being slightly smaller the length of the hole.

In one or more embodiments, button holes 116*a* and 116*b* may be configured to receive buttons 118*a* and 118*b* that may be attached to a fitted sheet (not shown). In such embodiment(s), buttons 118*a* and 118*b* on the fitted sheet may feed through button holes 116 and 116*b* that may secure pillows 110*a* and 110*b* to bed 102. This may reduce the likelihood of pillows 110*a* and 110*b* within pillowcases 108*a* and 108*b* falling off of bed 102. Buttons 118*a* and 118*b* may be attached to an outer facing side of the fitted sheet using stitches or other various attachment methods, such as fabric glue or staples or other mechanisms. The stitches may be of any type among a variety of stitching patterns. The fitted sheet may be compatible to any bed size, such as twin, queen, or king, any shape of mattress, such as four-sided or round, and any mattress type, such as spring, waterbed, or foam. Buttons 118*a* and 118*b* may be attached to an upper zone of the fitted sheet. The upper zone may be an area of the fitted sheet where a user may rest their head. In other embodiment(s), buttons 118*a* and 118*b* may be attached to the fitted sheet along the upper zone and a bottom zone of the fitted sheet, where the bottom zone may normally be located near the user's feet. In embodiment(s), buttons 118*a* and 118*b* may be located throughout the perimeter of the fitted sheet.

Buttons 118*a* and 118*b* of the fitted sheet may feed through button holes 116*a* and 116*b* of pillowcases 108*a* and 108*b* to secure pillowcase to the bed. In one or more embodiments, each pillowcase 108*a* and 108*b* may contain more than one button hole 116*a* and 116*b*, where one button hole 116*a* and 116*b* may be configured to receive buttons 118*a* and 118*b* attached to pillowcases 108*a* and 108*b* and the other button hole 116*a* and 116*b* may be configured to receive buttons 118*a* and 118*b* of the fitted sheet as described above. In one or more embodiments, buttons 118*a* and 118*b* may be attached to pillowcases 108*a* and 108*b* on a side opposite to button holes 116*a* and 116*b*. In other embodiment(s), pillowcases 108*a* and 108*b* may further include button holes 116*a* and 116*b* on a same side of pillowcases 108*a* and 108*b* as buttons 118*a* and 118*b* that may be configured to receive buttons 118*a* and 118*b* of the fitted sheet.

In one or more embodiments, the fitted sheet may include holes (not shown) and pillowcases 108*a* and 108*b* may include extra buttons (not shown). The holes on the fitted sheet may be configured to receive the extra buttons on pillowcases 108*a* and 108*b*. The extra buttons may be located on an outer side of pillowcases 108*a* and 108*b* such that buttons 118*a* and 118*b* and the extra buttons may be attached on the same side of pillowcases 108*a* and 108*b* and buttons 118*a* and 118*b* may face the opposite direction relative to the extra buttons. In embodiment(s), buttons 118*a* and 118*b* may be attached on the same side and may face the same direction as the extra buttons. The holes on the fitted sheet may be located on the upper zone of the fitted sheet. In other embodiment(s), the holes on the fitted sheet may be located on the fitted sheet along the upper zone and the bottom zone of the fitted sheet. In one or more embodiments, the holes on the fitted sheet may be located throughout the perimeter of the fitted sheet.

Various embodiments are described herein with relation to top sheet 106, but upon studying the present disclosure one would appreciate that these descriptions can also apply to a fitted sheet and securing the same to a blanket. For example, in one or more embodiments, the fitted sheet may include buttons and blanket 104 may include button holes 112*a-d*. The buttons on the fitted sheet may be configured to secure to button holes 112*a-d* on blanket 104. Such embodiment(s), may secure blanket 104 to the fitted sheet or bed without top sheet 106, and allow for users to have a secured blanket disposed directly on top of them while in bedding system 100.

In one or more other embodiments, the buttons on the fitted sheet may be configured to secure top sheet 106 and blanket 104 onto the fitted sheet. In this scenario, top sheet 106 may be configured with button holes (not shown) corresponding to the buttons on the fitted sheet. In one or more other embodiments there may also be buttons on the top sheet 106 in addition to button holes and these buttons may be used to further secure top sheet 106 to blanket 104. Furthermore, blanket 104 may be configured with additional button holes (not shown), while in some cases also retaining button holes 112*a-d*. The buttons on the fitted sheet, the button holes of top sheet 106, and the additional button holes of blanket 104 may be located around their perimeters. The buttons on the fitted sheet may feed through the button holes of top sheet 106 and/or the additional button holes of blanket 104, securing both top sheet 106 and blanket 104 to the fitted sheet and allowing for users to have a secured top sheet and blanket disposed directly on top of them while in bedding system 100. In one or more embodiments, there may be four buttons on the fitted sheet, four holes on the top sheet 106 and four holes on the blanket 104, all located approximately near an edge of the bed 102. In these embodiments, users may feed two adjacent buttons on either side of bed 102 through the corresponding holes on top sheet 106 and blanket 104, allowing the users to easily leave the bed, while securing top sheet 106 and blanket 104 to the fitted sheet. In one or more embodiments, on a side opposite to pillows 110*a-b*, e.g., an area of bed that is normally occupied by the users' feet, there may be button holes corresponding to buttons around the same location, allowing users to easily leave the bed while securing top sheet 106 and blanket 104 to the fitted sheet. In one or more embodiments, the fitted sheet and/or the top sheet may have button holes and the blanket may have buttons (not shown) that are configured to feed through the button holes of the top sheet and/or fitted sheet. In one or more embodiments, the fitted sheet may be attached to top sheet 106, which may further be attached to blanket 104 through the aforementioned buttons and button holes. In one or more embodiments, there may be more or less buttons and buttonholes on fitted sheet, top sheet, and/or blanket.

Figure 2:
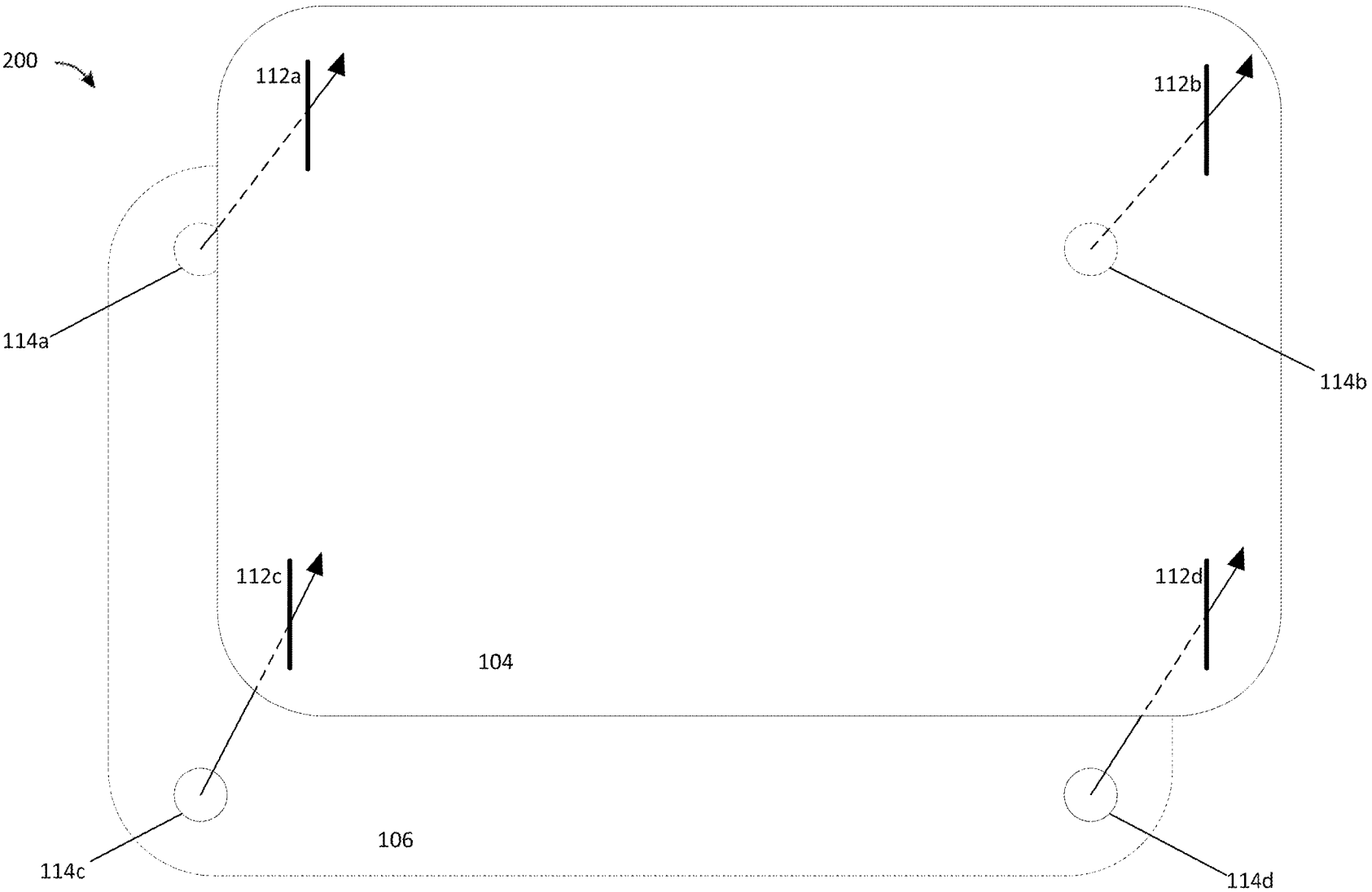
FIG. 2 depicts an exploded view of a blanket with at least one button hole configured to receive a button to secure the blanket to a top sheet using the at least one button, according one or more embodiments of the present disclosure.

FIG. 2 depicts an exploded view of a blanket with at least one button hole configured to receive and secure to a top sheet with at least one button, according to various embodiments of the present disclosure. An attached blanket and top sheet 200 may include co-blanket 104 and top sheet 104. As previously mentioned and as illustrated in FIG. 2, blanket 104 may include four button holes 112(*a*)-(*d*) and top sheet 106 may include four buttons 114(*a*)-(*d*). In one or more embodiments, top sheet 106 and blanket 104 may be of the same or similar size, meaning they may be configured to fit a similar sized beds, e.g., both queen sized sheets. In one or more embodiments, blanket 104 and top sheet 106 may be configured for different bed sizes. Button holes 112 of blanket 104 may be configured to mate with buttons 114 of top sheet 106. Here, when blanket 104 is placed on top of top sheet 106, buttons 114 on top sheet 106 may be approximately located near the corresponding button holes 112 of blanket 104, allowing buttons 114 to thread through button holes 112. In one or more embodiments, at least one hole may be purposefully misaligned for decorative purposes or to further secure portions of a pillow. For example, a person who brings their body more forcefully downward may benefit from additional buttons on a portion of the pillowcase closer to their shoulders, as it may secure the pillowcase further for greater motion and impact.

In one or more embodiments, the attached blanket and top sheet 200 may include top sheet 106 with more buttons 114 than the number of button holes 112 on blanket 104. In these embodiment(s), at least two holes align with two buttons such that blanket 104 is attached to top sheet 106, creating an attached blanket and top sheet 200. Here, the excess buttons 114 may not be used. The unused buttons may secure bedroom accessories such as blanket heaters, aromatherapy packs, and any other accessory that one may want secured to their bedding.

Similarly, in one or more embodiments, attached blanket and top sheet 200 may include top sheet 106 with less buttons 114 than the number of button holes 112 on blanket 104. In these embodiment(s), at least two button holes may align with two buttons such that blanket 104 is attached to top sheet 106, creating an attached blanket and top sheet 200. Here, the unused button holes 112 may remain unoccupied or may be used to hold bedroom accessories to the blanket, for example, a tube of a CPAP machine may be hooked to the unused button hole to secure the tubing to the bed.

Figure 3:
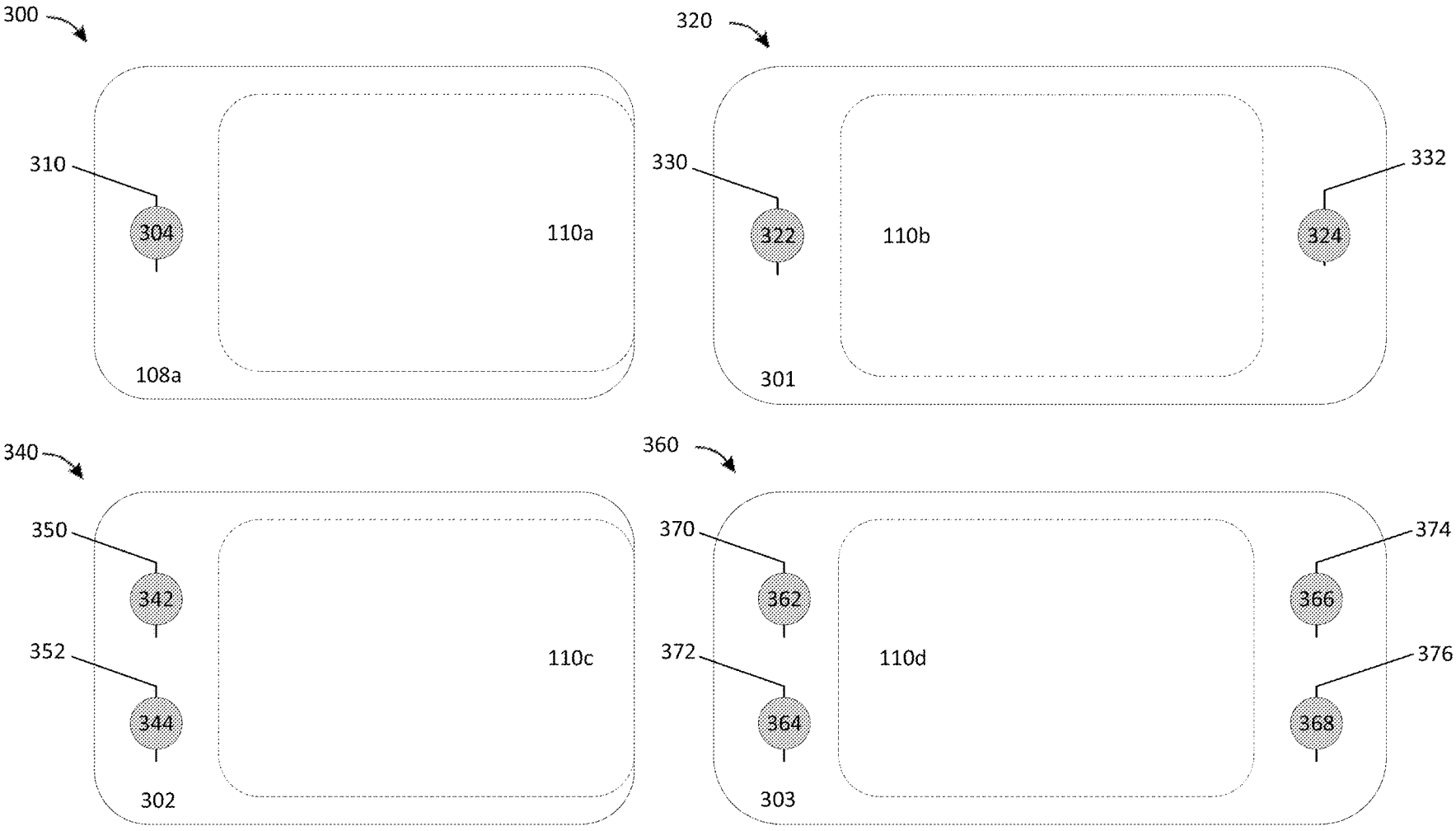
FIG. 3 depicts several examples of a pillowcase with at least one button configured to be coupled to at least one button hole on a lip of the pillowcase, according to one or more embodiments of the present disclosure.

FIG. 3 depicts several examples of pillowcases with at least one button configured to be secured to at least one button hole on a lip of the pillowcase, according to one or more embodiments of the present disclosure. As previously mentioned and as referenced in FIG. 1, an attached pillowcase 300 may include pillowcase 108*a* that may be configured to receive pillow 110*a*. Referring to FIG. 3, pillowcase 108*a* may be approximately a rectangular shape with two layers of fabric that are attached on all sides except one, leaving an opening, further including an inner side (e.g., inside the pillowcase where the pillow insert is placed) and an outer side (e.g., around an exterior of the pillowcase where one places their head or the pillowcase rests on the fixed sheet). Pillowcase 108 may include button hole 310 and button 304. Button hole 310 and button 304 may be located near the opening of pillowcase 118*a*. Button 304 may be located within the inner side near the opening of pillowcase 108*a* and may be located on a side opposite to a corresponding button hole 310.

Attached pillowcase 320 may include pillowcase 301 that may be configured to receive pillow 110*b*. Pillowcase 301 may be a rectangular shape including two layers of fabric that can be attached on two sides leaving two openings on opposite ends of pillowcase 301, further including an inner side (e.g., inside the pillowcase where the pillow insert is placed) and an outer side (e.g., around an exterior of the pillowcase where one places their head or the pillowcase rests on the fixed sheet). Pillowcase 320 may include button holes 330 and 332 and buttons 322 and 324. Button holes 330 and 332 and buttons 322 and 324 may be located near the openings of pillowcase 301. Buttons 322 and 324 may be located within the inner side near the openings of pillowcase 301 and may be located on a side opposite to button holes 332.

Attached pillowcase 340 may include pillowcase 302 and pillow 110*c*. Pillowcase 340 may be a rectangular shape including two layers of fabric that are attached on all sides except one, leaving an opening, an inner side, and an outer side. Pillowcase 302 may include two holes 350 and 352 and two buttons 342 and 344 located on the same opening side of pillowcase 302. Button holes 350 and 352 and buttons 342 and 344 may be located near the opening of pillowcase 302. Buttons 342 and 344 may be located within the inner side near the opening of pillowcase 302 and may be located on a side opposite to button holes 350 and 352 respectively.

Attached pillowcase 360 may include pillowcase 303 that may be configured to receive pillow 110*d*. Pillowcase 303 may be a rectangular shape and may include two layers of fabric that can be attached on two sides, leaving two opening on opposite ends of pillowcase 303, further including an inner side (e.g., inside the pillowcase where the pillow insert is placed) and an outer side (e.g., around an exterior of the pillowcase where one places their head or the pillowcase rests on the fixed sheet). Pillowcase 320 may include button holes 370, 372, 374, and 376, and corresponding buttons 362, 364, 366, and 368. Button holes 370, 372, 374, and 376, and buttons 362, 364, 366 and 368 may be located near the openings of pillowcase 303. Button holes 370 and 372 may be located near one of the openings, and holes 374 and 376 may be located near the opposite side opening. Buttons 362, 364, 366, and 368 may be located on the inner side near the openings of pillowcase 303 and may be located on a side opposite to button holes 370, 372, 374, and 376 respectively.

Figure 4:
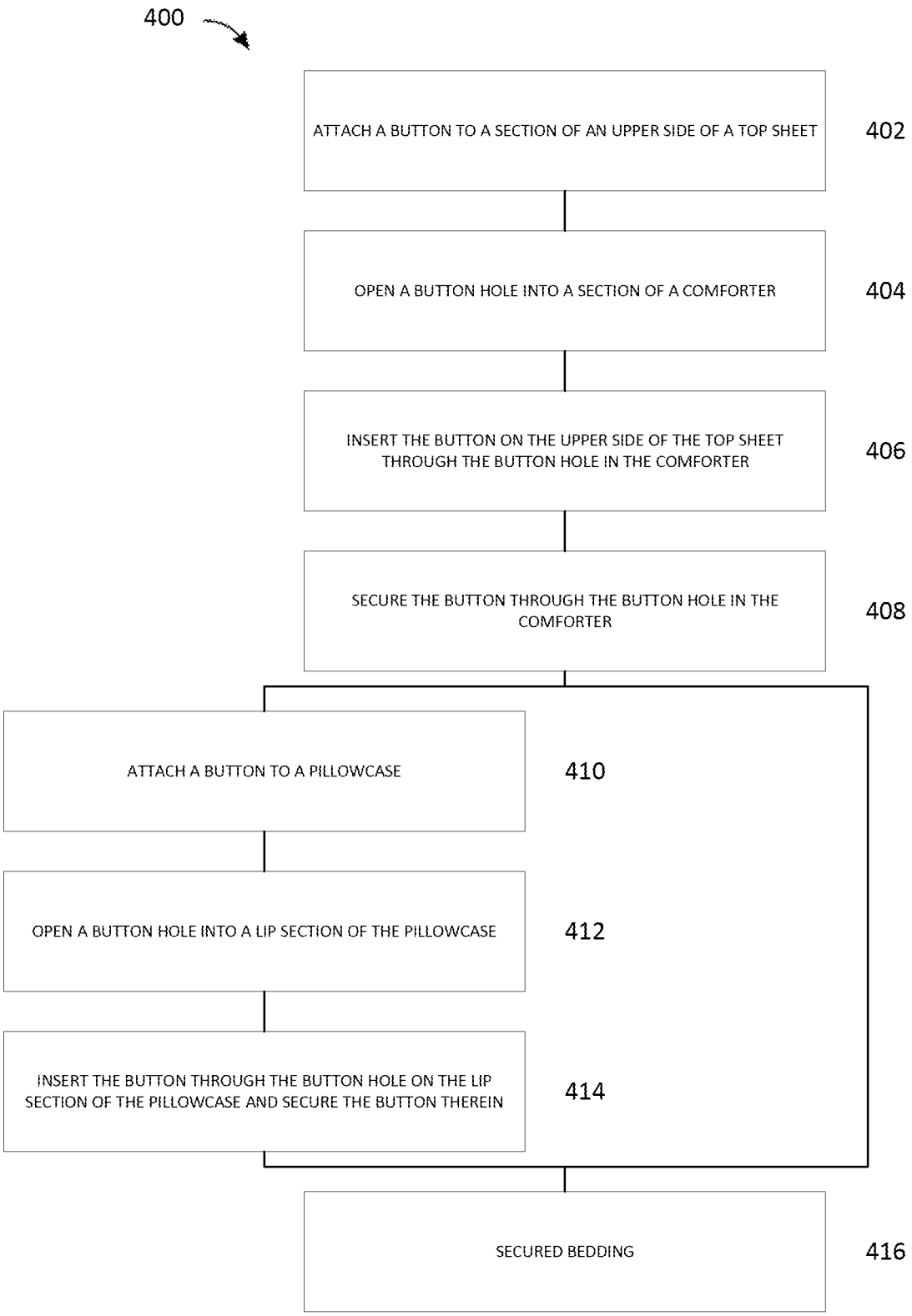
FIG. 4 is an example flow diagram showing a method of manufacturing a bedding set and a method of securing the bedding set once it is manufactured, according to one or more embodiments of the present disclosure.

FIG. 4 is an example flow diagram showing method 400 of manufacturing a bedding set and method 400 of securing the bedding set once it is manufactured, according to one or more embodiments of the present disclosure. At operation 402, the method may include attaching a button to a section of an upper side of a top sheet. At operation 404, the method may include opening a button hole in a section of a blanket. At operation 406, the method may include inserting the button on the upper side of the top sheet through the button hole in the blanket. At operation 408, the securing of the button through the button hole in the blanket. At operation 410, attaching a button to a pillowcase. At operation 412, opening a button hole into a lip section of the pillowcase. At operation 414, inserting the button through the button hole on the lip section of the pillowcase and secure the button therein. At operation 416, securing the bedding.

The disclosed technology reduces the likelihood of comforters, quilts, or blankets separating from top sheets or other bedding. By using, e.g., buttons to attach the top sheet to the comforter, quilt, or blanket, this attachment joins the position of the top sheet and the blanket. Separation may be limited to occurrences when the buttons detach, which is unlikely to occur during sleep or other normal use of the bed. Similarly, using buttons to close the pillowcase may reduce the likelihood of a pillow being inadvertently retracted from its pillowcase during sleep or other use of the pillow. With the user having better control over the blanket and pillow, the present disclosure may reduce the likelihood of restless sleep or other disturbances resulting from misaligned or misoriented comforters, blankets, and quilts or retracted pillows.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features that can be implemented by using a variety of alternative architectures and configurations. Indeed, it will be apparent to one of skill in the art how alternative functional, logical or physical partitioning and configurations can be applied to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A system comprising:

a sheet comprising at least four buttons wherein each of the at least four buttons of the sheet further comprises a case material and a compressible button filler, wherein the case material encapsulates the compressible button filler to form a three dimensional shape;

a blanket comprising a cover material, a filler, and at least four button holes attachable to the at least four buttons of the sheet, wherein each of the at least four buttons of the sheet is attachable to each of the at least four button holes of the blanket by feeding the at least four buttons of the sheet through, respectively, the at least four button holes of the blanket;

a pillowcase with at least one button, wherein the at least one button of the pillowcase comprises a case material and a compressible button filler, wherein the case material of the button of the pillowcase encapsulates the compressible button filler to form a three dimensional shape;

wherein the pillowcase further comprises a lip, wherein the lip comprises at least one button hole;

wherein the at least one button hole on the lip is attachable to the at least one button of the pillowcase and wherein the at least one button of the pillowcase is attachable to the at least one button hole on the lip by feeding through the at least one button of the pillowcase through the at least one button hole on the lip of the pillowcase such that the pillowcase is securable around a pillow;

wherein the case material and the compressible button filler of the at least four buttons of the sheet and the at least one button of the pillowcase comprise a soft fabric or cloth configured to allow the user to interact with the at least four buttons of the sheet and the at least one button of the pillowcase while not being disturbed by the at least four buttons of the sheet or the at least one button of the pillowcase pressing into the user's body and to prevent the user from impacting one or more attachments of the at least four buttons of the sheet to the sheet and one or more attachments of the at least one button of the pillowcase to the pillowcase while using the sheet and the pillowcase; and wherein the filler of the blanket, the compressible button filler of the at least four buttons of the sheet, and the at least one button of the pillowcase comprise the same material.

2. The system of claim 1, wherein the three dimensional shapes of the at least four buttons of the sheet and the at least one button of the pillowcase are a substantially round flattened ball shape.

3. The system of claim 1, wherein each of the at least four buttons of the sheet is attached to the sheet using a plurality of stitches.

4. The system of claim 1, wherein the blanket comprises reinforcements around each of the at least four button holes of the blanket.

5. The system of claim 1, wherein the sheet and the blanket are configured to prevent the sheet from becoming congested or misaligned in relation to the blanket.

6. A bedding securing set comprising:

a sheet with an upper side and a bottom side, wherein the upper side of the sheet comprises four quadrants, wherein each quadrant further comprises at least one button;

wherein the at least one button in each quadrant of the sheet further comprises a case material and a compressible button filler, wherein the case material encapsulates the compressible button filler to form a three dimensional shape;

a blanket comprising at least one material, the blanket comprising four quadrants wherein each quadrant further comprises at least one button hole, wherein the at least one button hole in each quadrant of the blanket is attachable to the at least one button of each quadrant of the upper side of the sheet, wherein the at least one button in each quadrant of the sheet is attachable to the at least one button hole in each quadrant of the blanket by feeding the at least at least one button in each quadrant of the sheet through, respectively, the at least on button hole in each quadrant of the blanket;

a pillowcase with a lip wherein the lip comprises at least one button hole and at least one button; wherein the at least one button of the pillowcase comprises a case material and a compressible button filler, wherein the case material of the pillowcase encapsulates the compressible button filler to form a three dimensional shape;

wherein the at least one button hole on the lip is attachable to the at least one button of the pillowcase and wherein the at least one button of the pillowcase is attachable to the at least one button hole on the lip, wherein the at least one button of the pillowcase is attachable to the at least one button on the lip of the pillowcase by feeding the at least one button of the pillowcase through the at least one button on the lip of the pillowcase such that the pillowcase is securable around a pillow;

wherein the case material and the compressible button filler of the at least one button in each quadrant of the sheet and the at least one button of the pillowcase comprise a soft fabric or cloth configured to allow the user to interact with the at least one button in each quadrant of the sheet and the at least one button of the pillowcase while not being disturbed by the at least one button in each quadrant of the sheet or the at least one button of the pillowcase pressing into the user's body and to prevent the user from impacting one or more attachments of the at least one button in each quadrant of the sheet to the sheet and one or more attachments of the at least one button of the pillowcase to the pillowcase while using the bedding securing set; and wherein the compressible button filler of the at least four buttons of the sheet, and the at least one button of the pillowcase comprise one of the at least one material of the blanket.

7. The bedding securing set of claim 6, wherein the case material of the at least one button in each quadrant of the sheet and the pillowcase are made from the same material as the sheet.

8. The bedding securing set of claim 6, wherein the button filler of the at least one button in each quadrant of the sheet and the pillowcase are made from cotton.

9. The bedding securing set of claim 6, wherein the three dimensional shapes of the at least one button in each quadrant of the sheet and the pillowcase are substantially round flattened ball shape.

10. The bedding securing set of claim 6, wherein the at least one button in each quadrant of the sheet is attached to the sheet using a plurality of stitches.

11. The bedding securing set of claim 6, wherein the blanket comprises reinforcements around the button holes in each quadrant of the blanket.

12. The bedding securing set of claim 6, wherein the blanket further comprises at least one false button.

13. The bedding securing set of claim 6, wherein the sheet and the blanket are configured to prevent the sheet from becoming congested or misaligned in relation to the blanket.

14. A method of manufacturing a bedding set, the method comprising;

attaching at least four buttons onto an upper side of a sheet;

wherein each of the at least four buttons of the sheet are formed by encapsulating a compressible button filler with a case material to form a three dimensional shape and wherein the case material and the compressible button filler of the at least four buttons of the sheet comprise a soft fabric or cloth configured to allow the user to interact with the at least four buttons of the sheet while not being disturbed by the at least four buttons of the sheet pressing into the user's body and to prevent the user from impacting one or more attachments of the at least four buttons of the sheet to the sheet while using the bedding set;

opening at least four button holes in a blanket that further comprises a cover material and a filler, wherein each of the at least four button holes is attachable to each of the at least four buttons of the upper side of the sheet, wherein the at least four buttons of the sheet is attachable to each of the at least four button holes of the blanket by feeding the at least four buttons of the sheet through, respectively, the at least four button holes of the blanket; and wherein the filler of the blanket and the compressible button filler of the at least four buttons of the sheet comprise the same material.

15. The method of manufacturing the bedding set of claim 14, further comprising: attaching at least one button onto a pillowcase and opening at least one button hole in a lip section of the pillowcase, wherein the at least one button of the pillowcase comprises a case material and a compressible button filler, wherein the case material of the pillowcase encapsulates the compressible button filler to form a three dimensional shape;

wherein the at least one button hole is attachable to the at least one button of the pillowcase and wherein the at least one button of the pillowcase is attachable to the at least one button hole by feeding the at least one button of the pillowcase through the at least one button hole on the lip of the pillowcase such that the pillowcase is securable around a pillow;

wherein the case material and the compressible button filler of the at least one button of the pillowcase comprise a soft fabric or cloth configured to allow the user to interact with the at least one button of the pillowcase while not being disturbed by the at least one button of the pillowcase pressing into the user's body and to prevent the user from impacting one or more attachments of the at least one button of the pillowcase to the pillowcase while using the bedding set; and wherein the filler of the blanket and the at least one button of the pillowcase comprise the same material.

16. The method of manufacturing the bedding set of claim 14, wherein the compressible button filler of the at least four buttons of the sheet are made from cotton, a same material as the sheet, or a combination thereof.

17. The method of manufacturing the bedding set of claim 14, wherein each of the at least four buttons of the sheet is attached to the sheet using a plurality of stitches.

18. The method of manufacturing the bedding set of claim 14, wherein reinforcements are stitched around each of the at least four button holes on the blanket.

* * * * *